United States Patent [19]

Moreland

[11] Patent Number: 4,778,310

[45] Date of Patent: Oct. 18, 1988

[54] MEANS FOR INSTALLING MEMBRANES IN CONTAINMENT PITS FOR TANKS STORING LIQUIDS

[75] Inventor: Jack Moreland, Chicago, Ill.

[73] Assignee: MPC Containment Systems, Ltd., Chicago, Ill.

[21] Appl. No.: 930,788

[22] Filed: Nov. 14, 1986

[51] Int. Cl.[4] ..... E02D 19/00

[52] U.S. Cl. ..... 405/270; 220/18; 405/53

[58] Field of Search ..... 405/50, 53, 54, 128, 405/129, 270; 137/236.1; 220/18

[56] References Cited

U.S. PATENT DOCUMENTS

| | | | |
|---|---|---|---|
| 3,504,496 | 4/1970 | Hnot | 405/53 |
| 4,110,947 | 9/1978 | Murray et al. | 405/54 X |
| 4,366,846 | 1/1983 | Curati | 405/53 X |
| 4,580,925 | 4/1986 | Matich et al. | 405/53 X |
| 4,592,846 | 6/1986 | Metzger et al. | 405/50 X |

*Primary Examiner*—David H. Corbin

*Attorney, Agent, or Firm*—Laff, Whitesel, Conte & Saret

[57] ABSTRACT

The invention process for installing an overliner membrane begins with preparing a site by digging a pit for the installation of fuel tanks, for example, which may be associated with leakage or spillage of fluids. Then, ballast is packed under and around the tanks to support and stabilize their position, the ballast rising to a level which is above the tanks but below points where the leakage or spillage may occur. Next, a frame is built over the ballast in the area where the leakage or spillage may occur. A membrane is spread across the surface of the ballast and attached to the frame in order to form a basin in which this leakage or spillage may collect. The frame and the membrane are completely covered with ballast in a manner which maintains the side walls of the membrane in a vertical position. A trench system for delivery pipes carrying fuel from the tank to outlying locations contains a trench liner membrane which surrounds the pipes and drains into the membrane basin.

10 Claims, 5 Drawing Sheets

COMPARATIVE PROPERTIES CHART

| PROPERTY | HYPALON | NEOPRENE | NORDEL | ELASTICIZED POLYOLEFIN |
|---|---|---|---|---|
| ADHESION TO FABRICS | GOOD | EXCELLENT | GOOD | N/A |
| TEAR RESISTANCE | EXCELLENT | EXCELLENT | EXCELLENT | GOOD |
| ABRASION RESISTANCE | EXCELLENT | EXCELLENT | EXCELLENT | GOOD |
| PERMEABILITY TO GASES | LOW | LOW | FAIR | FAIR |
| ACID RESISTANCE | | | | |
| DILUTE | EXCELLENT | EXCELLENT | EXCELLENT | EXCELLENT |
| CONCENTRATED | VERY GOOD | GOOD | POOR | VERY GOOD |
| SOLVENT RESISTANCE | | | | |
| ALIPHATIC HYDROCARBONS | GOOD | GOOD | POOR | FAIR |
| AROMATIC HYDROCARBONS | POOR | FAIR | POOR | FAIR |
| OXYGENATED (KEOTONES, ETC.) | POOR | POOR | GOOD | GOOD |
| RESISTANCE TO | | | | |
| SWELLING IN LUBRICATING OIL | GOOD | GOOD | POOR | POOR |
| OIL AND GASOLINE | FAIR | GOOD | POOR | FAIR |
| ANIMAL & VEGETABLE OIL | GOOD | GOOD | GOOD | GOOD |
| WATER ABSORPTION | GOOD | GOOD | GOOD | EXCELLENT |
| OXIDATION | EXCELLENT | EXCELLENT | EXCELLENT | EXCELLENT |
| OZONE | OUTSTANDING | EXCELLENT | OUTSTANDING | EXCELLENT |
| SUNLIGHT AGING | OUTSTANDING | VERY GOOD | OUTSTANDING | EXCELLENT |
| HEAT AGING | EXCELLENT | EXCELLENT | EXCELLENT | GOOD |
| HEAT | GOOD | GOOD | EXCELLENT | GOOD |
| COLD | GOOD | GOOD | EXCELLENT | GOOD |

FIG. 2 (A)

COMPARATIVE CHEMICAL RESISTANCE CHART

| FLUID | HYPALON | NEOPRENE | NORDEL | ELASTICIZED POLYOLEFIN |
|---|---|---|---|---|
| CREOSOTE OIL | C | C | C | T |
| CYCLOHEXANE | C | C | C | C |
| DETERGENT SOLUTION | ------ | ------ | ------ | A |
| DIABASIC ACIDE (C7-C12) | ------ | ------ | ------ | T |
| DIOCTYL PHTHALATE | C | C | C | A |
| ETHYL ACETATE | C | C | A | T |
| ETHYL ALCOHOL | A(158°F) | A(158°F) | A | A |
| ETHYLENE GLYCOL | B(158°F) | A(158°F) | A | A |
| FERRIC CHLORIDE | T | A | A | T |
| FLUOBORIC ACID | A | ------ | ------ | ------ |
| FLUOSILIC ACID | A(158°F) | A(158°F) | T | T |
| FORMIC ACID | A | A | A | A |
| FUEL OIL | B | ------ | ------ | ------ |
| FURFUROL | A | B | B | T |
| GASOLINE | B | B | C | C |
| GLUCOSE | A(158°F) | ------ | ------ | ------ |
| GLUE | A(158°F) | A(158°F) | A | A |
| GLYCERINE | A(158°F) | A(158°F) | A | T |
| HYDRAULIC OILS | B | ------ | ------ | ------ |
| HYDROCHLORIC ACID 37% | B(158°F) | A | B | B |
| HYDROCHLORIC ACID (CONC.) | ------ | ------ | ------ | ------ |
| HYDROCYANIC ACID | B | A | A | T |
| HYDROFLUORIC ACID 48% | B | A | B | T |
| HYDROFLUORIC ACID 75% | ----- | B | C | C |
| HYDROGEN SULFIDE | B | A | A | T |
| ISOPROPYL ALCOHOL | ------ | A | T | T |
| KEROSENE | X | B | C | C |
| LACQUER SOLVENTS | C | C | C | T |
| LACTIC ACID | A | A | A | T |
| LINSEED OIL | A | A | B | T |
| LUBRICATING OILS | B | B(158°F) | C | C |

FIG. 2(B)

COMPARATIVE CHEMICAL RESISTANCE CHART

| FLUID | HYPALON | NEOPRENE | NORDEL | ELASTICIZED POLYOLEFIN |
|---|---|---|---|---|
| TANNIC ACID 10% | A | A | A | ------ |
| TARTARIC ACID | B | A(158°F) | B | ------ |
| TOLUENE | C | C | C | C |
| TRIBUTYL PHOSPHATE | C | C | C | A |
| TRICHLOROETHYLENE | C | C | C | C |
| TRIETHANOLAMINE | A(158°F) | A(158°F) | A | ------ |
| TUNG OIL | A | A | C | ------ |
| TURPENTINE | C | C | C | C |
| VM+P NAPHTHA | ------ | ------ | ------ | C |
| WATER | A | A(212°F) | A(212°F) | A |
| XYLENE | C | C | C | C |

FIG. 2(C)

MEANS FOR INSTALLING MEMBRANES IN CONTAINMENT PITS FOR TANKS STORING LIQUIDS

This invention relates to containment systems and more particularly to means for and methods of installating membranes in containment pits for tanks storing liquids and semi-liquids which are hazardous to the environment.

Reference is made to my co-pending U.S. patent application Ser. No. 06/709,597 filed Mar. 8, 1985 and to its parent application No. 06/586,782 filed Mar. 6, 1984, for a description of a system which might use this invention.

There was a day when not too much attention was given to storage of liquids which are hazardous to the environment. As a result, underground water supplies have been contaminated, fumes have leaked into the atmosphere, and unhealthy conditions have occurred. Therefore, governments have written many laws, rules, and regulations to prevent further pollution.

Today, those who store such liquids often do so in underground tanks buried in pits filled with sand, pebbles, and the like, called "ballast". However, such a tank may leak or liquid may be spilled on the surface of the earth in the area around the tank and seep down into the ballast. One way to prevent environmental damage from happening is to line the pit with a membrane before the ballast is installed. This way any leakage or spillage is collected in the bottom of a basin formed by the membrane. It is fairly easy to install the membrane when the earthen walls of the pit are present to support it while it is being installed.

Another way of preventing the leakage of liquids from the underground tanks is to make them of a double walled construction. Then, if one wall leaks, the second wall remains to contain the leakage. However, there is a remaining problem of collecting and removing spillage upon the surface of the earth, as when an attempt is made to pump fuel into the tank before the hose is properly secured to a fill tube of the tank.

To provide for collection of such spillage with double walled tanks, the common practice is to place an "overliner" above the tanks, around the area where a spillage is most likely to occur. Here, the practice has been to dig a pit, install the tanks, partially fill the pit with ballast to a level which covers the tanks, install the overliner membrane, and then finish filling the pit with ballast up to the surface level of the earth. The difficulty with this approach is that the ballast which is added to the pit when the overliner is installed tends to shift, slide, and otherwise provide an unreliable support for the overliner membrane. As the ballast slides or avalanches, the overliner may become dislodged or may be damaged to a point of failure.

Accordingly, an object of this invention is to provide new and improved means for and methods of installing overliner membranes in pits in which liquid storage tanks are buried. Another object is to provide means for collecting and centralizing leakage and spilled fluids in order to facilitate a clean up thereof. In this connection, an object is to return remote leakage through a trench into a basin formed by an overliner membrane.

Another object of the invention is to provide apparatus which facilitates an installation of an overliner membrane at such a low cost that it may be abandoned at the point of installation.

In keeping with an aspect of the invention, these and other objects are accomplished by providing a frame, which may be made of conventional water pipe, for example, put together with conventional pipe fittings. The frame is set upon properly graded ballast which drains any collected liquids toward a collection point. The membrane is spread over the graded ballast and then hung from the pipe frame. Then, the remaining ballast is installed on both sides of the membrane so that it becomes a basin with a floor and with vertical sides which are always fully supported. A result is that the membrane basin is in the form of an open topped box in order to collect and retain any leakage or fluid which may be spilled on the surface. Various fittings enable structures, such as service wiring, to enter the basin and to collect fluids in remote locations, which drain into the basin.

A preferred embodiment of the invention is shown in the attached drawing, wherein:

FIG. 2 is a table giving the physical characteristics of a preferred membrane, the table being taken from my co-pending application Ser. No. 06/709,597, filed Mar. 8, 1985;

Figure 1:
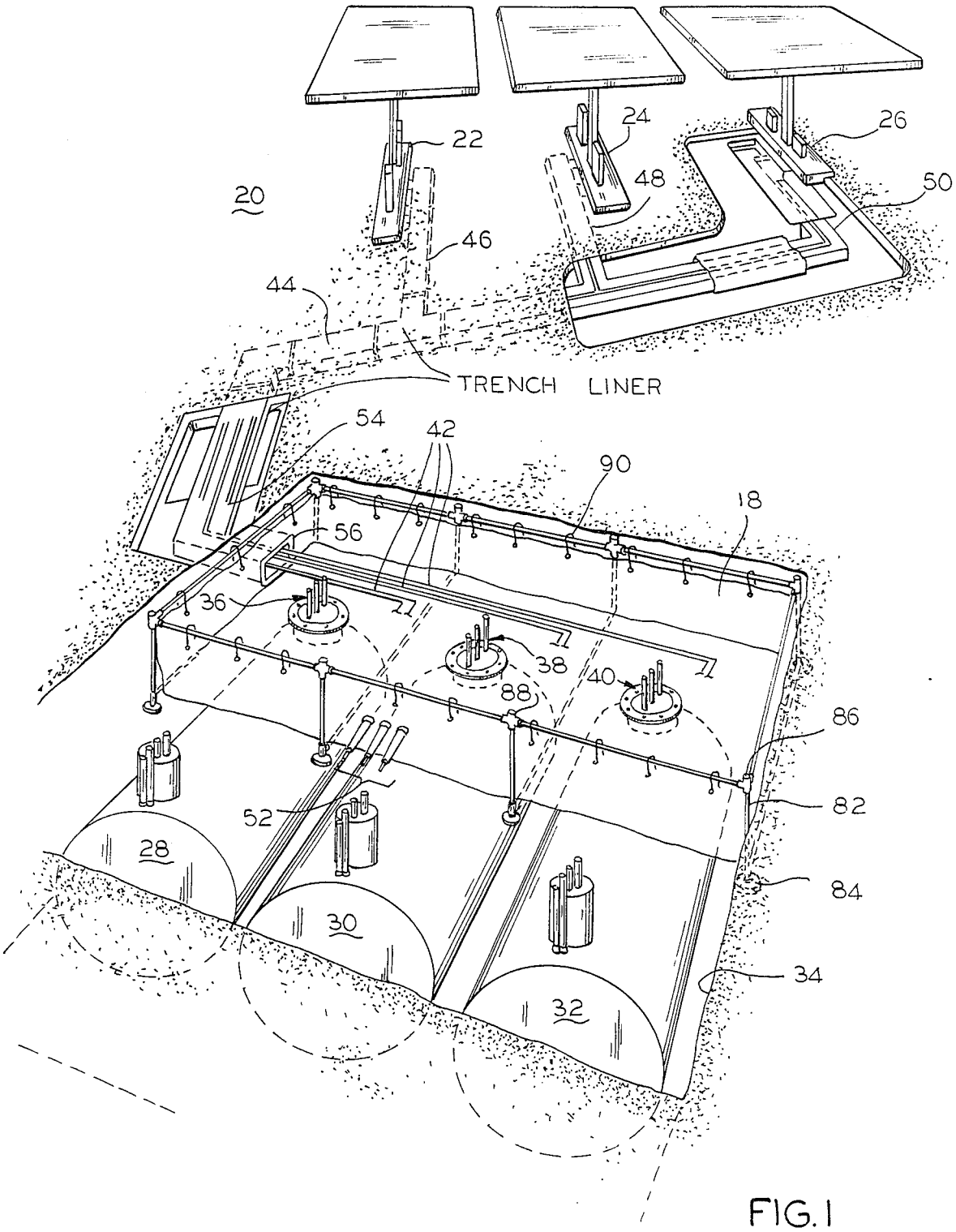
FIG. 1 is a perspective view of the inventive secondary container overliner membrane being installed in the area of a fuel delivery system.

The material used to make the membrane described herein depends upon the chemical properties of the liquid in the tanks, pipes and pumps. FIG. 2 is a chart originally published by the DuPont company which identifies their various materials and which indicates their preference for materials to be used in connection with any of many different liquids. Other suppliers have similar tables for their products. The preferred material for the inventive gasoline containment includes a DuPont polyester elastomer sold under the trademark "HYTREL". In respect of the "HYTREL" material used as the liner of the second containment system, the inventive membrane is described by the following specifications:

HYTREL REINFORCED SYNTHETIC LINING SPECIFICATIONS: L28105540

| PROPERTY | TEST METHOD | MINIMUM DESIGN REQUIREMENT | HYTREL VALUE |
|---|---|---|---|
| Thickness | ASTM 751 | +/−2% .028 to .030 | .030 |
| Weight | Method 5041 | 26+/−2 oz./sq. yd. | 25.3 |

-continued

HYTREL REINFORCED SYNTHETIC LINING SPECIFICATIONS: L28105540

| PROPERTY | TEST METHOD | MINIMUM DESIGN REQUIREMENT | HYTREL VALUE |
|---|---|---|---|
| Tear Strength | Fed. Std. 191a Method 5134 | 200 lbs/200 lbs. | 260/240 |
| Breaking Strength | Fed. Std. 191a ASTM D-751 Strip Tensile | 350 lbs/250 lbs. | 384/270 |
| Puncture Resistance | FTMS 101B Method 2031 | 300 lbs. | 325 |
| Low Temperature | ASTM D-2136 4 hrs., ⅛" mandrel | −50°/no cracking | pass |
| Dimensional Stability (each direction) | ASTM D-1204 | 2% maximum | pass |
| Hydrostatic Resistance | ASTM D-751 Method A | 500 psi (min) | pass |
| Blocking Resistance | Method 5872 Fed. Std. 191a | #2 Rating | pass |
| Adhesion-ply | ASTM D-413 2" per min. | 30 lbs/in (min) On film tearing bond | 35 |
| Dead Load withstand | (Mil-T-43211 (GL) pass | | Must |
| seam sheer strength | Para 4.4.4 (4 hours) | 105 lbs./in. @ 70° F. 62.5 lbs./in. @ 160° F. | |
| Abrasion Resistance | Method 5306 Fed. Std. 191a H-18 Wheel 1000 gram load | 2000 cycles before fabric exposure 50 mg/100 cycles max. wt. loss | 8000 |
| Weathering | Carbon-Arc Atlas Weather-o-meter | 3000 hrs. No appreciable changes or cracking of coating | pass |
| Water Absorption | ASTM D-471 7 days | 5% max. @ 70° F. 12% max. @ 212° F. | pass |

In general, the membrane is resistant to the same classes of chemicals and fluids that are resisted by polyurethanes. Moreover, the membrane does not contain an extractable plasticizer, as do some vinyls, nylon and rubber compounds. The membrane is also resistant to deterioration in most hot and moist environments.

The preferred procedure for making the membrane, which has these characteristics and which meets these specifications, is to first provide a loosily woven scrim, approximately 2,000 denier, which is made of polyester fibers. Then, a liquid form of HYTREL is used to coat the scrim on both sides and to fill in the openings between the fibers, with the scrim suspended in a manner so that its fibers become embedded in the middle of the finished sheet thickness dimension. At room temperature, the resulting membrane is resistant to most polar fluids—such as acids, bases, amines glycols, gasoline, oil, hydraulic fluid, and the like.

Each of the membrane sections which is used in the pit and trench is joined to its neighboring membranes sections, in a waterproof manner. For example, the trench liner may be joined to the pit liner by welding, zippers, or the like.

FIG. 1 shows an exemplary location where the invention is used in order to install an overliner membrane 18. This location is shown, by way of example as a filling station 20 having three islands 22, 24, 26 where gasoline dispensing pumps are located. Three underground tanks 28, 30, 32 are buried in a pit 34, dug into the earth. Each tank is assumed to have double walls or another self protection device which eliminates a need for an underlining such as is shown in my above identified co-pending application. However each of these three tanks has fill pipes 36, 38, 80 which represent points when fluid may be spilled, as the tanks are filled.

Also each of the service island pumps 22–26 receives its fuel from the tanks via delivery pipes extending through trenches 44–50. Anyone of these delivery pipes could rupture or leak. Finally, each user of the pumps may perform some careless act which may result in spillage at the pumps that could leak into and seap through the earth.

Other apparatus may also require access into the basin formed by the inventive overliner membrane. For example, this apparatus might be represented by electrical wiring 52 which could extend to pumps associated with the individual tanks. These wires must be able to enter the membrane basin without providing a path for pollutant fluids to escape from the basin and into the environment.

According to the invention taught in my co-pending patent application No. 06/709,597, the delivery pipes extend through a trench system 44–50 which is lined with a membrane (as at 54) and then the pipe system is installed. This trench membrane 54 extends out to and under the entire area around the service islands where spillage may occur. Next, a ballast is poured over the membrane and around the pipes. When the ballast copletely covers the pipes, the trench membrane 54 is wrapped around it and sealed onto itself. The membrane 54 surrounding the pipes is joined to the overliner containment membrane 18 in a leakproof manner by a bulkhead clamping plate 56, as shown in my above identified co-pending application. The trench system is graded so that any leakage of fluids from the pipe system or spillage in the service areas 22–26 drains into the overliner containment membrane 18.

Figure 3:
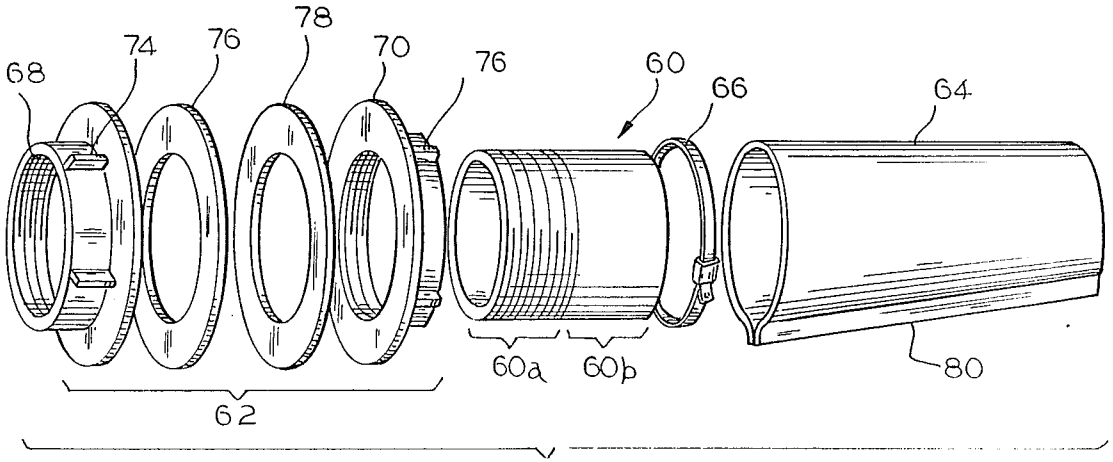
FIG. 3 is a perspective view of a bushing for granting entry of structures into a basin formed by overliner membrane.

FIG. 3 shows a bushing for enabling the entrance of apparatus, such as wires, pipes, etc. at 52 (FIG. 1). The principal elements of the bushing of FIG. 3 are a cylinderical tube 60 which is threaded on one end 60*a* and smooth on the other end 60*b*, a pair 62 of flanges and resilient washers, a sleeve 64 of membrane material, and a hose clamp 66.

The flanges 68, 70 have internal threads which mate with the threads 60*a* on the cylinder 60. A plurality of projecting fins, such as 74, 76, extend from the hub of each flange in order to facilitate a tightening of the flanges when on the cylinder 60. A pair of resilient washers 76, 78 fit over th threaded end 60*a* of cylinder 60 and are secured between the end faces of the flanges. The membrane 18 has a hole (not shown) which also fits over the threaded end 60*a* of the cylinder 60 and between the resilient flanges 76, 78. Thus, when the flanges 68, 70 are tightened against each other, there is a watertight seal between the membrane 18 and the bushing of FIG. 3.

The membrane sleeve 64 is a sheet of membrane material wrapped upon itself and sealed at a heat welded seam 80. The sleeve tapers from the diameter of the cylinderical seaction 60 to a diameter of the incoming pipe on the other end. A standared hose clamp 66 attaches the end of sleeve 64 to the unthreaded end 60*b* of cylinder 60, in a conventional manner.

Figure 4:
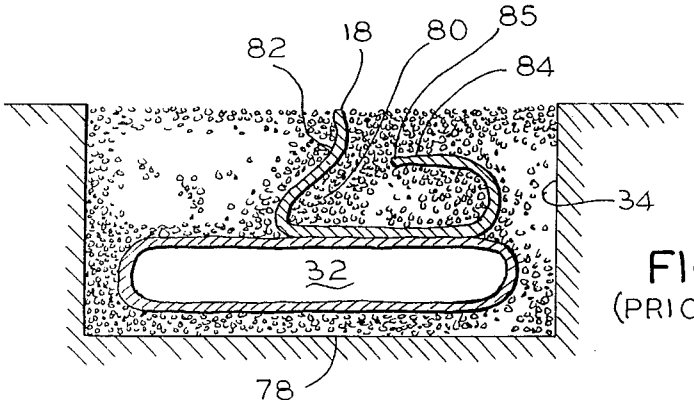
FIG.4 (PRIOR ART)
FIG. 4 is a schematic and stylized showing of problems encountered while installing a prior art overliner membrane.

FIG. 4 illustrates the prior art method of installing the overliner membrane, somewhat exaggerating a few of the problems which have been encountered. First the pit 34 was dug and then enough ballast was installed at 78 to insure that the tank 32 would be stable and fully supported. When the ballast reaches some desirable level above the top of the tank, the overliner membrane 18 was laid out over the ballast.

Then, more ballast is added on each side of the membrane as its sides raise to form the basin. As shown in FIG. 4, it is assumed that the ballast inside the membrane, at 80, was spread before there was enough ballast outside the membrane to hold it in place. Therefore the membrane bulged out to the left. Then, to bring the raising membrane wall back into position, more ballast was dumped at 82 and the membrane bulged out to the right before the inside of raising membrane wall was fully supported on the inside. Thus, the membrane first spread outwardly at 80 and then inwardly at 82. The resulting stresses could tear the membrane. Also, pockets could form in the side wall to collect fluid which could not be pumped out of the membrane basin. At 84, the raising vertical wall of the membrane was being shored in a proper manner, but then it is assumed that an avalanche of the ballast buried the edge 85 of the membrane 18. This burial will require a removal of the ballast, and perhaps damage the membrane, in the process.

FIG. 4 has been drawn to exemplify a only few of the problems which may occur in a conventional installation. Of course, no cave in or distortion of the membrane can be predicted because if it could be predect, it could also be prevented. Still, the problems do occur with great frequency. Thus, it is apparent that even a skilled and careful worker can experience problems of these or similar types.

According to the invention, a frame 82 (FIGS. 1, 5, and 6) is constructed in the area of the ballast which is to receive and support the overliner membrane 18. A particularly low cost and perfectly satisfactory way of constructing the frame is to make it from water pipe because all of the conventional fittings may be used. These fittings include flanges 84, angles 86, and tees 88. Of course, many other fittings may be used to build any of many differently shaped fences, which could fit into almost any installation.

Then, the edges of the overliner membrane 18 are hooked onto each of the pipes (as at 90) at intervals along the length of the pipe. Thus, the membrane is fully supported by the ballast under it and its edges are supported in an elevated position by the frame 82.

Figure 5:
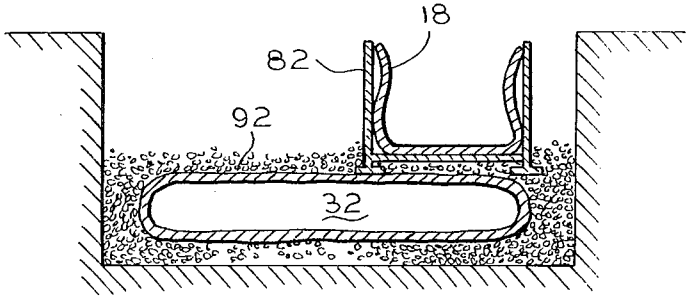
FIGS. 5, 6 are schematic and stylized showings of the inventive means for and methods of installing the overliner membrane.
Figure 6:
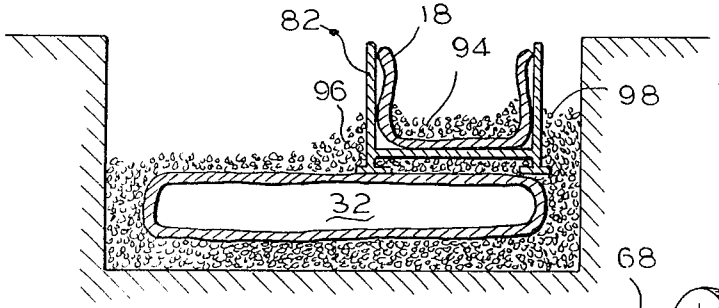

At the time when the frame is installed (FIG. 5), it is resting directly on the ballast 92 covering the top of the tank 32. The frame will be abandoned at this site when the installation is completed. As shown in FIG. 5, the ballast 94 is poured into the basin formed by membrane 18 suspended inside the frame 82. At the same time, ballast is also poured outside the membrane, at 96, 98. As the pile of ballast increases both sides of the membrane are fully supported. However, unlike the prior art situation, the edges of membrane 18 are restrained so that they can not be dislodged by the kind of imbalance of ballast that is seen in FIG. 4.

Another advantage of the orderly installation that is shown in FIG. 5 is that the ballast may be more carefully graded so that liquid collecting in the bottom of the membrane can be drained or pumped away. Also, the better controlled vertical hang of the side walls tends to resist the kinds of dislocations that are illustrated in FIG. 3 and the like.

Those who are skilled in the art will readily perceive how to modify the system. Therefore, the appended claims are to be construed to cover all equivalent structures which fall within the true scope and spirit of the invention.

I claim:

1. A process for installing an overliner membrane within a drainage pit, the process comprising the steps of:

(a) preparing a site by forming a pit for the installation of apparatus which may be associated with leakage or spills of fluids;

(b) piling ballast under and around said apparatus to support and stabilize its position, said ballast rising to a level which is above said apparatus but is below points where said leakage or spillage may occur;

(c) building a frame over and resting upon said ballast in said area where said leakage or spillage may occur;

(d) covering the ballast inside said frame with an overliner membrane which spreads across the surface of said ballast and attaches to a level on said frame which is higher than said leakage or spillage may rise, said overliner membrane being held by said frame in a configuration which forms a collection basin to catch said leakage or spillage; and (e) covering said frame and membrane, both the outside and inside of said overliner membrane, with ballast and at a rate which maintains the side walls of said membrane in a vertical position.

2. The process of claim 1 wherein said ballast is graded in step (b) so that any leakage or spillage within the membrane collects in an area within said frame from which the collected fluid may be withdrawn to empty the basin formed by the membrane.

3. The process of claim 2 wherein said apparatus includes at least one double walled fuel tank and said membrane overlies said fuel tank.

4. The process of claim 3 wherein said site includes a trench system for receiving delivery pipes carrying fuel from said tank to outlying locations, and the added steps of lining said trench with a membrane means which surrounds said pipes, and joining to said trench membrane to said membrane basin overlying said fuel tank, said trench system being graded so that any leakage from said delivery pipes drains through a conduit formed by said trench liner membrane into said membrane basin within said frame.

5. The process of claim 4 and the added steps of giving entry into said basin formed by said membrane via a bushing comprising at least a pair of flanges in face to face confrontation with a pair of resilient washers captured therebetween, placing said flanges and washers on opposite sides of said membrane and tightening said flanges to secure said washers against said membrane, and attaching a sleeve to said bushing, said sleeve tapering from a diameter associated with said flange to a diameter of an article entering said membrane.

6. A system for containing leakage or spillage in a fuel storage and delivery area, said system comprising a pit at a site for the installation of at least one fuel tank which may have associated leakage or spillage of fluids, ballast packed under and around said fuel tanks to support and stabilize their position, said ballast rising to a level above said tanks and below points where said leakage or spillage may occur; a frame positioned over said ballast in an area where said leakage or spillage may occur; a membrane spread across the surface of said ballast and attached to a level on said frame which is higher then said leakage or spillage may rise thereby forming said membrane into a basin for collecting said leakage and spillage; and said frame and both the outside and inside of said membrane being covered by ballast at a rate which maintains side walls of said membrane in a vertical position.

7. The system of claim 6 wherein said ballast is graded before said membrane is spread so that any leakage or spillage within the membrane collects in an area within said membrane basin where it may be withdrawn.

8. The system of claim 7 wherein said membranes overlies said fuel tank.

9. The system of claim 8 wherein said, delivery area includes a trench system containing delivery pipes for carrying fuel from said tank to outlying locations, a trench liner membrane surrounding said pipes and joining to said membrane overlying fuel tank, said trench system being graded so that any leakage from said delivery pipes drains into the basin formed by said membrane.

10. The system of claim 9 and a bushing for giving entry into said membrane basin, said bushing comprising at least a pair of flanges in a face to face confrontation with a pair of resilient washers captured therebetween, said flanges and washers being on opposite sides of said membrane, and a sleeve attached to said bushing, said sleeve tapering from a diameter associated with said flange to a diameter of an article entering said membrane.

* * * * *